US006511628B2

(12) United States Patent
Gheorghiu et al.

(10) Patent No.: US 6,511,628 B2
(45) Date of Patent: Jan. 28, 2003

(54) METHOD FOR CONTROLLING THE FIRING OF CERAMICS

(75) Inventors: Tudor C. Gheorghiu, Painted Post, NY (US); Mark A. Spetseris, Pine City, NY (US)

(73) Assignee: Corning Incorporated, Corning, NY (US)

( * ) Notice: Subject to any disclaimer, the term of this patent is extended or adjusted under 35 U.S.C. 154(b) by 52 days.

(21) Appl. No.: 09/789,880

(22) Filed: Feb. 21, 2001

(65) Prior Publication Data

US 2002/0008334 A1 Jan. 24, 2002

Related U.S. Application Data

(60) Provisional application No. 60/184,106, filed on Feb. 22, 2000.

(51) Int. Cl.[7] ..... G31B 15/00; H05B 6/64

(52) U.S. Cl. ..... 264/406; 264/40.1; 264/432

(58) Field of Search ..... 264/40.1, 406, 264/432

(56) References Cited

U.S. PATENT DOCUMENTS 4,404,166 A * 9/1983 Wiech, Jr. ..... 419/36
5,046,946 A 9/1991 Yasuda et al.
5,078,929 A 1/1992 Matsumae et al.
5,183,609 A 2/1993 Miyahara
5,256,347 A 10/1993 Miyahara
5,262,102 A 11/1993 Wada
5,403,540 A 4/1995 Brundage et al.
5,725,829 A * 3/1998 Miyahara et al. ..... 264/630
6,027,684 A 2/2000 Gheorghiu et al.
6,048,199 A 4/2000 Dull et al.
6,089,860 A 7/2000 Dull et al.
6,099,793 A 8/2000 Dull et al.

OTHER PUBLICATIONS

U.S. patent application, SN 09/727,184 filed Nov. 30, 2000, J. Brennan, "Hybrid Method for Firing of Ceramics".

* cited by examiner

*Primary Examiner*—Christopher A. Fiorilla
(74) *Attorney, Agent, or Firm*—Anca C. Gheorghiu; Timothy M. Schaeberle

(57) ABSTRACT

A method of firing ceramic bodies and includes placing the ceramic material in a heating apparatus and subjecting the ceramic material to an amount of heat energy that results in the ceramic article exhibiting a ceramic body core temperature, $T_c$, a ceramic body surface temperature $T_s$, and surface-core temperature differential that is less than or equal to a predetermined maximum temperature differential setpoint.

5 Claims, 3 Drawing Sheets

METHOD FOR CONTROLLING THE FIRING OF CERAMICS

This application claims the benefit of U.S. Provisional Application No. 60/184,106, filed Feb. 22, 2000, entitled "METHOD FOR CONTROLLING THE FIRING OF CERAMICS", by Gheorghiu et al.

BACKGROUND OF THE INVENTION

1. Field of the Invention

The invention relates to method for manufacturing ceramic materials. In particular, this invention relates to a method for firing ceramics involving separately measuring the interior and surface temperatures and controlling the heating rate of the ceramic material in response to the measured difference.

2. Discussion of the Related Art

Conventional heating used in the manufacturing of ceramic materials typically comprises gas firing or electric resistance heating. Utilization of conventional radiative/convective heating typically results in a temperature differential within the ceramic body, due to the fact that heat is applied only to the surface and it relies mainly on thermal conductivity of the ceramic body, typically poor, to effect the temperature beneath the surface and into the interior of the piece. In other words, conventional heating involves heat transfer that is predominantly achieved by radiation or convection to the surface followed by conduction from the surface into the interior of the ceramic body. If a core-surface temperature differential develops that is too great, cracking and distortion of the ceramic body can occur. Fast firing further exacerbates this problem of poor heat transfer, and ultimately cracking. Additionally, the presence of a core-surface temperature gradient can also result in uneven sintering, specifically surface sintering prior to, and at a faster rate than, interior sintering. As a result, the ceramic body may exhibit non-uniform properties.

Conventional control of the heating used in the manufacturing of ceramic materials typically involved controlling the quantities of heat generated in, or transferred to, the ceramic body by measuring the ambient temperature within an enclosure containing the ceramic body. Based on, and in response to, this ambient temperature measurement, the heat transferred to the ceramic body, is controlled by use of any one of the following heating types: passive or forced convection, and/or conduction. Similarly, radiation heating such as microwave heating, though resulting in the heat being generated within the ceramic body, also involves the use of ambient temperature-based control of the heating. This ambient temperature-based control method of heating the ceramic body, though standard in the ceramic industry, suffers from a number of shortcomings including the following: (1) the mixing of kiln gases may not be uniform enough to accurately predict the ceramic body surface temperatures, thus reducing the effectiveness of the method; (2), many of the chemical reactions that occur within the ceramic body take place at temperatures low enough that ambient gas radiant heat transfer is not a primary means of heat transfer to the ceramic body and to the inside surfaces of the kiln where the kiln ambient temperatures are measured; and, (3) control of the temperature in the kiln space and not control of the temperature of the actual piece does not provide a means for indirectly measuring the stresses exhibited by the ceramic body being heated.

SUMMARY OF THE INVENTION

Accordingly it is an object of this invention to provide a method of, efficiently and effectively controlling the heat energy utilized in the heating of ceramics that overcomes the shortcomings of the aforementioned conventional methods of controlling the heating and/or sintering of ceramics.

The firing method of present invention comprises placing the ceramic material in a heating apparatus and subjecting the ceramic material to an amount of heat energy that results in the ceramic article exhibiting a ceramic body core temperature, $T_C$, a ceramic body surface temperature $T_S$, and surface-core temperature differential that is less than or equal to a predetermined maximum temperature differential setpoint. Preferably, the method furthermore involves continuously measuring the ceramic body core temperature, $T_C$, and the surface temperature $T_S$, calculating the measured surface-core differential and adjusting the heat in response to the difference between the measured surface-core differential and the predetermined maximum surface-core differential setpoint.

DETAILED DESCRIPTION OF THE INVENTION

Figure 1:
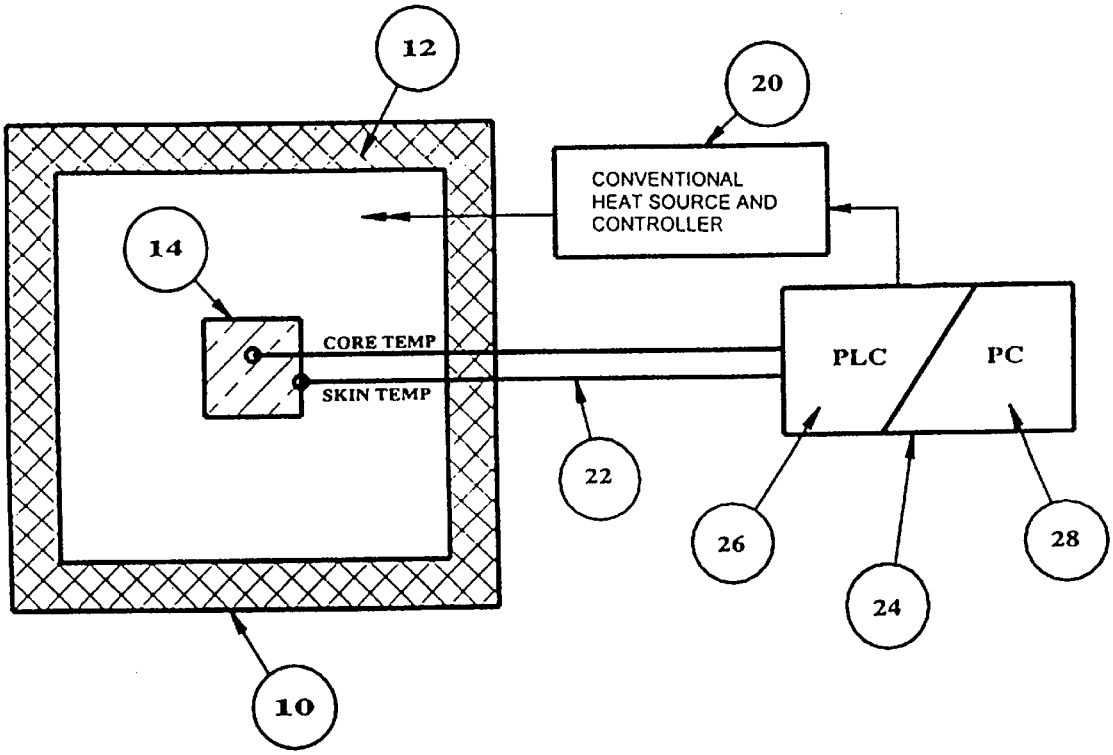
FIG. 1 is a block diagram of an apparatus illustrating the basic system for sintering a ceramic article according the inventive firing method described herein.

Referring to FIG. 1, shown is a basic system for heating ceramic materials according to the method described herein. This system comprises a heating unit or kiln 10, comprising a thermally insulated wall 12, within which is located a ceramic article 14 to be sintered. The system includes a heat source/controller 20 for continuously adjusting the heat within the thermally insulated enclosure. It is contemplated that the heat source can comprise, convective, conductive or radiant heat, including, but not limited to, electric resistance, microwave, gas heating, or a combination of these.

A temperature measurement system 22 capable of measuring both the ceramic article's surface temperature and the temperature proximate the center of the ceramic article, i.e., the core temperature, is coupled to a control unit 24, that independently controls the heat source/controller 20. This control unit preferably comprises a combination of a programmable logic controller (PLC) 26 and a personal computer (PC 28). The temperature measurement system 22 comprises any appropriate temperature sensors (not shown) capable of measuring both surface and core temperature of the ceramic article. The term core as used throughout refers the interior portion of the ceramic article at or near the center of the particular ceramic article, however the core temperature can be measured at any position in the interior of the ceramic article that accurately reflects the temperature of the core. Suitable sensors include, for example, a pyrometer (or other thermographic device), a sheathed or unsheathed thermocouple, light pipe or black body probe.

In operation, the ceramic material is subjected to an amount of heat energy by subjecting the ceramic article to an amount of heat. It is contemplated that the ceramic article could be subject to a combination of heat sources; the combination utilized could include an active means to provide heat into the product interior, such as microwave energy or forced convection through a cellular product, and a heating means that directly transfers that heat to the outside surface of the ceramic article, such as gas or electric resistance heat. The amount of heat is such that the ceramic article is heated according to the minimum-temperature profile while still exhibiting an acceptable temperature or thermal differential. In other words, this acceptable temperature differential and associated setpoints and resultant time-temperature profile is determined so as to heat the ceramic article through its sintering temperature in a manner that results in the production of a ceramic article that, exhibits the required characteristics of the ceramic material; specifically, a crack-free, undistorted ceramic article exhibiting essentially uniform properties. Utilization of this time-temperature profile and acceptable temperature differential, is best suited for use during those temperature ranges during which the ceramic body exhibits either exothermic or endothermic reactions and/or large dimensional change. Although this method is most suitable for these aforementioned firing temperature ranges, it can be used during any firing temperature range, except for those times where the time-temperature is specified; e.g. an extended temperature hold at a specific temperature.

Specifically, the surface and core temperatures may be as far apart, temperature-wise, as to result in the maximum temperature differential that the ceramic article can withstand; i.e., an acceptable temperature differential between the surface and core temperatures. An acceptable temperature differential is one that results in a fired ceramic product that exhibits substantially uniform properties and is substantially crack and distortion free. The acceptable temperature differential varies from ceramic material to ceramic material and varies throughout the firing cycle for a given ceramic body and is a function of various mechanical properties such as strength, shrinkage, elastic properties, thermal properties, the rate of product dimensional change, as well as the shape the ceramic article exhibits. More particularly, for a given material the acceptable temperature differential is less during periods where the ceramic body is subject to high stress. High stress typically occurs during those periods where the ceramic body is undergoing exothermic, endothermic reactions and large dimensional changes; during these times the ceramic body is typically subject to a large temperature differential that has a dimensional change associated with them.

Based on the above temperature differential characteristics, it is contemplated that the method of control is designed whereby the maximum surface-core temperature differential and associated setpoints for any given time is programmed into the PLC, so as to provide for the following condition—the core and surface temperatures maintained are within the acceptable temperature differential setpoint of the ceramic article to be sintered during each stage of the firing process. Additionally, it should be noted that the temperature differential programmed should be specified to provide a safety margin to account for pre-existing flaws or stresses in the green body.

It should be noted that the acceptable temperature differential should take into account the general temperature uniformity within the kiln as a function of the ceramic article's location in the kiln. Burners, heating elements and the type of energy source may effect the overall temperature uniformity of the surface of the ceramic articles in the kiln in various locations. For example, the application of microwave energy to the kiln typically induces a thermal difference in the interior of ceramic articles placed in different locations in the kiln. Although attempts to equally apply the energy sources effecting the surface and interior of the ceramic articles in different locations in the kiln (i.e. high velocity, pulse fired burners; multi-mode waveguides and stirrers), some non-uniformity must result and should be accounted for in the acceptable thermal differential programmed into the PLC.

As previously mentioned, the benefit of utilizing the inventive control method, is that the firing cycle can be reduced to the shortest practical time while still producing crack-free ceramic, structures exhibiting uniform properties.

In a preferred embodiment, the actual control of heat or energy source involves continuously measuring the ceramic body core temperature, $T_C$, and the surface temperature $T_S$. The amount of heat supplied to the interior of the kiln is adjusted in response to the difference between the temperature differential calculated, and the maximum temperature differential setpoint. If the measured temperature differential is less than the maximum temperature differential setpoint, there is an increase of output from the heating source resulting in an increase in the product surface temperature relative to the interior piece temperature and vice versa. The maximum temperature differential setpoint is programmed into the PLC and PC combination that functions to adjust the conventional heat accordingly.

It is within the knowledge of one skilled in the art to predetermine the appropriate temperature differential between the core and surface temperature of the piece to be fired for the different temperature ranges, and thus the resulting time-temperature profile maintained by the kiln, necessary to fire the article to it's sintering or soak temperature to thereby avoid cracking of the ceramic body, as well as the formation of non-uniform properties. In other words, maintaining the acceptable temperature differential indirectly controls the heating rate that that the kiln will maintain. As previously discussed, factors including the ceramic composition, mechanical and thermal properties, geometry of the ceramic body, and capabilities of the kiln should be considered in setting up the parameters of the firing process, and thus the heating rate and corresponding, acceptable temperatures differential setpoint sufficient to achieve a the optimum firing cycle that results in the aforementioned sintered, crack and distortion-free, uniform property ceramic article. For example, the firing cycle, including any sintering or soak period, for a cylindrical thin-wall ceramic body exhibiting a 7 in. length, a diameter of 3.866 in. and possessing a 2.0 mil cell wall thickness and 900 cell/in$^2$ and comprising a predominantly cordierite phase involves subjecting the ceramic article to the requisite amount of gas or electric heating in order to maintain the core-skin thermal equilibrium, for a period not to exceed 75 hours.

Stated another way, the inventive method described herein involves placing the ceramic body in a heating apparatus comprising a heatable, thermally insulated kiln apparatus and heating the body to an elevated core temperature and an elevated surface temperature by subjecting it to an amount of heat energy. The amount of conventional heat energy to which the body is subjected would be regulated to raise the surface temperature of the body at a rate such that difference between the elevated core and surface temperatures does not exceed the aforementioned and predetermined acceptable temperature differential.

Cordierite ceramic articles are disclosed here by way of example, however it should be noted that the invention disclosed herein is acceptable for use with any composition of ceramic article in addition to cordierite, including, but not limited to aluminum titanate honeycomb ceramics, alumina bricks, silica bricks, zirconia refractory bodies, high alumina ceramic insulators. In other words this inventive method of control is suitable for any inorganic/ceramic bodies that exhibit a temperature differential during the firing of the bodies.

Detailed in TABLE I is a time-temperature profile (surface and core temperatures and temperature differential) for a heating cycle utilizing the inventive control method for a standard cordierite body heated through a typical binder burnout region. Table I also includes for comparison purposes a time-temperature profile (same core temperature, surface temperature and temperature differential) for a standard control firing process.

Between the surface temperatures of between 360° C. and 500° C. the cordierite body exhibits an exothermic reaction due to organic burn out. The heat released at the surface of the piece is easily removed and thus the skin of the piece does not overheat. The heat released inside the piece is not so easily removed and the core of the piece typically becomes hotter than the skin.

In the conventional firing example, the skin temperature is represented in Table I as "T Skin in time/temp. firing" and temperature differential is represented as "delta T process variable in time/temp. firing". In this comparative example, the core becomes hotter than the skin at skin temperatures between 410° C. and 460° C.; a situation that is likely to result in cracks being produced in the sintered body. Cracking is likely to result due to the fact that there is usually a dimensional change during binder removal, resulting in some part of the product being placed in tension. If the tensile stress exceeds the strength of the part, a crack will usually occur.

The inventive control method functions to maintain a temperature differential in the piece that does not produce thermal stresses higher than the ceramic body is capable of withstanding. A maximum temperature differential (Tcore−Tskin) is programmed as a set point, in this case ranging from −20° C. to −10° C. The kiln has to maintain the skin temperature from 10 C. to 20° C. above core temperature, depending on where in the program the core temperature is. In the case of a rapidly heating core, the kiln will increase the heat input, the skin will be heated faster, and the skin will be always hotter than the core with the value set in the recipe as the difference. In this example, the surface temperature in the inventive method of controlling the firing, is reported in TABLE I under the heading: "T Skin adjusted for the delta T firing".

Figure 2:
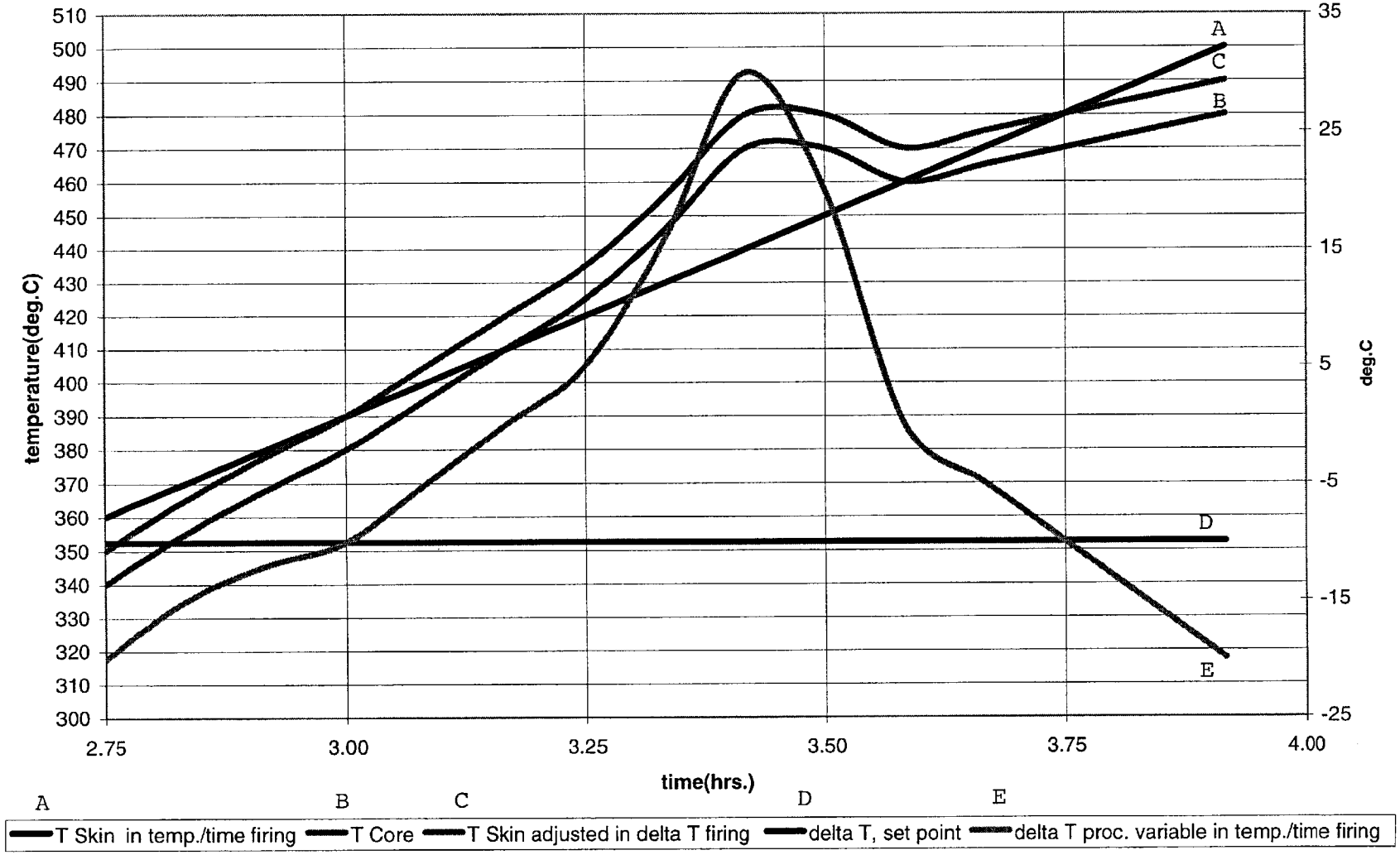
FIG. 2 is graph illustrating time-temperature profiles, of measured core and surface temperatures for both the inventive and conventional firing methods, as measured during exothermic binder burnout period of a cordierite ceramic.

FIG. 2 is an illustrated version of the data that is listed in TABLE I. The temperature differential is controlled to this figure, −10° C. By contrast, in a conventional firing, the temperature differential becomes as large as +30, which results in cracking of the ceramic body.

TABLE I

| Time Hrs. | T Skin in time/temp. firing ° C. | T Core ° C. | T Skin adjusted in delta T firing ° C. | delta T, set point Tcore-Tskin ° C. | delta T process variable in time/temp. firing Tcore-Tskin ° C. |
|---|---|---|---|---|---|
| 2.75 | 360 | 340 | 350 | −10 | −20 |
| 2.83 | 370 | 355 | 365 | −10 | −15 |

TABLE I-continued

| Time Hrs. | T Skin in time/temp. firing ° C. | T Core ° C. | T Skin adjusted in delta T firing ° C. | delta T, set point Tcore-Tskin ° C. | delta T process variable in time/temp. firing Tcore-Tskin ° C. |
|---|---|---|---|---|---|
| 2.92 | 380 | 368 | 378 | −10 | −12 |
| 3.00 | 390 | 380 | 390 | −10 | −10 |
| 3.08 | 400 | 395 | 405 | −10 | −5 |
| 3.17 | 410 | 410 | 420 | −10 | 0 |
| 3.25 | 420 | 425 | 435 | −10 | 5 |
| 3.33 | 430 | 446 | 456 | −10 | 16 |
| 3.42 | 440 | 470 | 480 | −10 | 30 |
| 3.50 | 450 | 470 | 480 | −10 | 20 |
| 3.58 | 460 | 460 | 470 | −10 | 0 |
| 3.67 | 470 | 465 | 475 | −10 | −5 |
| 3.75 | 480 | 470 | 480 | −10 | −10 |
| 3.83 | 490 | 475 | 485 | −10 | −15 |
| 3.92 | 500 | 480 | 490 | −10 | −20 |

Detailed in TABLE II is a time-temperature profile (surface and core temperatures and temperature differential) for a heating cycle utilizing the inventive control method for a standard cordierite body heated through a temperature region under which the cordierite body exhibits decomposition of certain raw materials. Table II also includes for comparison purposes a time-temperature profile (same core temperature, surface temperature and temperature differential) for a standard control firing process.

Between the surface temperatures of between the surface temperatures of 880° C. and 980° C. the cordierite body exhibits an endothermic reaction due to the decomposition of the raw materials used in the composition. The heat required by the reaction to take place is easily provided at the skin of the piece; but the core of the piece does not receive the amount of heat required by the endothermic reaction and lags behind.

In the conventional method of heating control, the surface temperature for the comparative example is reported in TABLE II as: "T Skin in time/temp. firing". The resulting measured core-surface temperature differential, calculated, as before, as Tcore−Tskin for the comparative example is reported in TABLE II as "delta T process variable in time/temp. firing". This comparative example is likely to result in cracks being produced in the piece for the same reason as explained above for the exothermic region: stresses are generated that exceed the strength of the part if dimensional changes occur.

In order to maintain a temperature differential in the piece that does not produce cracks the same method as described for the exothermic region is used. The kiln is programmed in such a way that instead of firing based on programmed temperature vs. time, the kiln fires based on a temperature differential setpoint. A temperature differential is programmed as a set point, in this case −20° C., requiring that the kiln maintain the skin temperature 20° C. above core temperature. The kiln will decrease the heat input, and the skin will be heated more slowly, thereby maintaining the temperature differential programmed as the set point. TABLE II reports the surface temperature in this inventive example as: "T Skin adjusted for the delta T firing.

Figure 3:
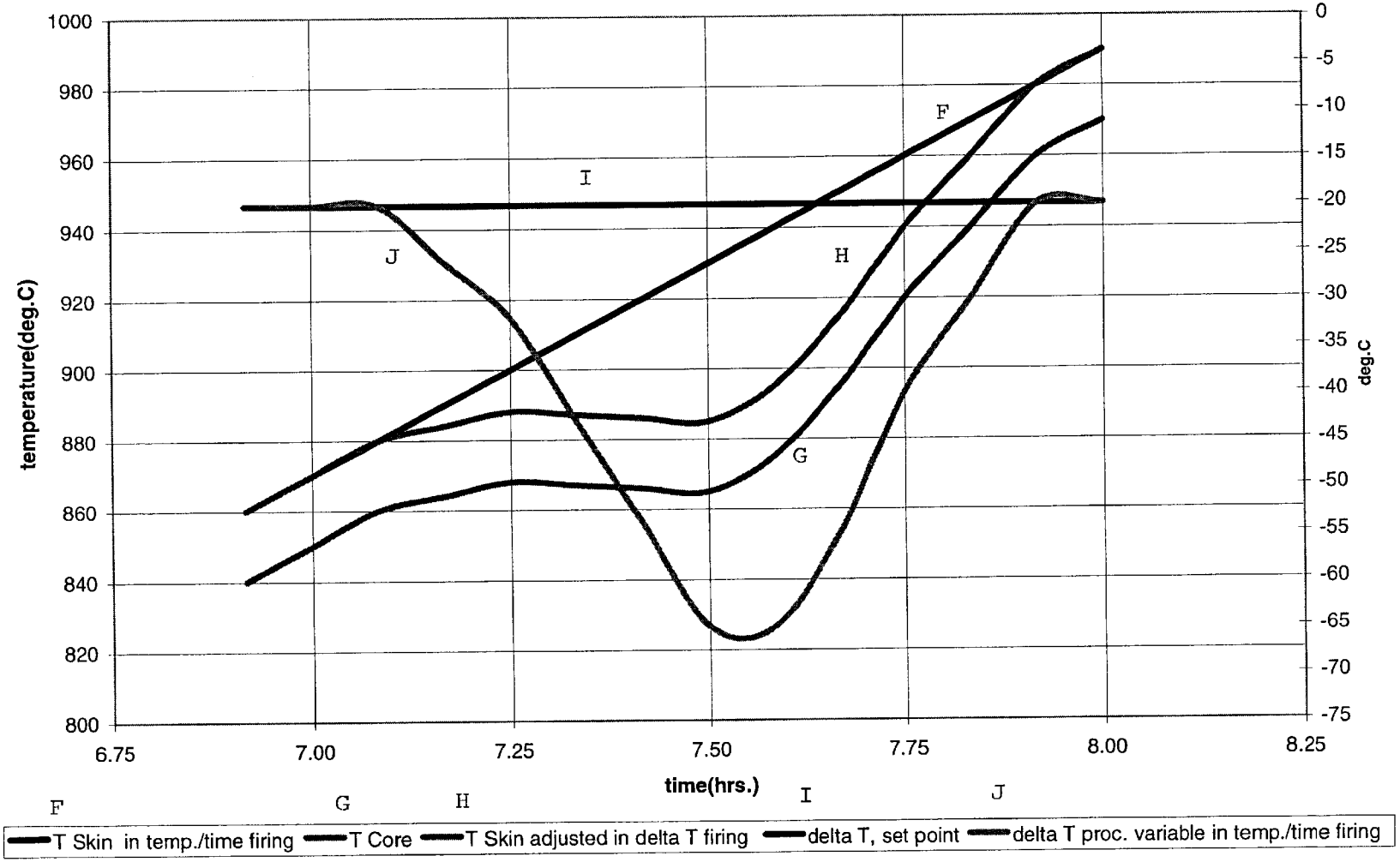
FIG. 3 is graph illustrating time-temperature profiles, of measured core and surface temperatures for both the inventive and conventional firing methods, as measured during a endothermic raw material decomposition phase of a cordierite ceramic.

FIG. 3 is an illustrated version of the data that is listed in TABLE I.

TABLE II

| time | T Skin in time/temp. firing | T Core | T Skin adjusted in delta T firing | delta T, set point Tcore-Tskin ° C. | delta T proc. variable in time/temp. firing Tcore-Tskin ° C. |
|---|---|---|---|---|---|
| 6.92 | 860 | 840 | 860 | −20 | −20 |
| 7.00 | 870 | 850 | 870 | −20 | −20 |
| 7.08 | 880 | 860 | 880 | −20 | −20 |
| 7.17 | 890 | 864 | 884 | −20 | −26 |
| 7.25 | 900 | 868 | 888 | −20 | −32 |
| 7.33 | 910 | 867 | 887 | −20 | −43 |
| 7.42 | 920 | 866 | 886 | −20 | −54 |
| 7.50 | 930 | 865 | 885 | −20 | −65 |
| 7.58 | 940 | 875 | 895 | −20 | −65 |
| 7.67 | 950 | 895 | 915 | −20 | −55 |
| 7.75 | 960 | 920 | 940 | −20 | −40 |
| 7.83 | 970 | 940 | 960 | −20 | −30 |
| 7.92 | 980 | 960 | 980 | −20 | −20 |

The method described herein is particularly suitable for use in the firing thinwall cellular ceramic bodies as well as thick cross section ceramic articles. Firing as used herein refers to a process of heating a ceramic article to a temperature to densify (sinter) a given ceramic and/or to complete the conversion into the desired crystalline phase.

Although the aforementioned method is detailed in terms of controlling a difference of temperature within one region of a part and another, such as skin versus core, it is contemplated that the method is equally suitable to a method wherein the results of several pieces are averaged together. However, this concept can be extended to a more general kiln control method, simply by placing thermocouples in various kiln locations, and specifying a temperature differential to be maintained between some combination of the thermocouple set.

Furthermore it is contemplated that this method can apply to any heating source, such as electric, gas fired, etc. As mentioned above, it can also be applied to multiple heat sources, such as microwave as is disclosed in the copending, co-assigned application of J. H. Brennan, titled "Hybrid Method of Firing Ceramics".

It should be understood that while the present invention has been described in detail with respect to certain illustrative and specific embodiments thereof, it should not be considered limited to such. It is contemplated that numerous modifications are possible without departing from the broad spirit and scope of the present invention as defined in the appended claims.

We claim:

1. A method for firing a ceramic body comprising:

a) establishing a core-surface temperature differential setpoint for the ceramic body:

b) placing the ceramic body in a heating apparatus comprising a heating source;

c) subjecting the ceramic body to a heating rate that results in the ceramic body exhibiting an elevated core temperature, Tc, and an elevated surface temperature, Ts; and d) controlling the elevated surface temperature, Ts, by adjusting continuously the amount of heat energy supplied to the interior of the heating apparatus from the heating source in response to a measured temperature difference between the elevated core temperature, Tc, and the elevated surface temperature, Ts, being greater than the core-surface temperature differential setpoint, such that the measured temperature between the elevated core temperature, Tc, and the elevated surface temperature, Ts, is maintained to be less than or equal to the core-surface temperature differential setpoint in order to obtain a fired ceramic product exhibiting substantially uniform properties, and is substantially crack and distortion free.

2. The method according to claim 1 wherein the acceptable temperature differential is maintained during at least a portion of firing during which the ceramic body is exhibiting endothermic or exothermic reactions and/or large dimensional changes.

3. The method according to claim 1 wherein the heat energy from the heating source is selected from the group consisting of convective heat, conductive heat and radiant heat.

4. The method according to claim 3 wherein the radiant heat is selected from the group consisting of electric resistance, microwave, gas heating, and combinations thereof.

5. A method according to claim 1 wherein the core-surface temperature differential setpoint varies throughout firing.

* * * * *

UNITED STATES PATENT AND TRADEMARK OFFICE

CERTIFICATE OF CORRECTION

PATENT NO. : 6,511,628 B2
DATED : January 28, 2003
INVENTOR(S) : Gheorghiu et al.

It is certified that error appears in the above-identified patent and that said Letters Patent is hereby corrected as shown below:

Column 8,
Line 8, “body:” should be -- body; --.
Line 23, “temperature between” should be -- temperature difference between --.

Signed and Sealed this

Sixth Day of May, 2003

JAMES E. ROGAN
*Director of the United States Patent and Trademark Office*